United States Patent [19]

Teisen-Simony

[11] Patent Number: 4,813,197

[45] Date of Patent: Mar. 21, 1989

[54] PLATE MOUNTING SYSTEM, ESPECIALLY FOR SIGNPOSTING PURPOSES, AND CONNECTING ELEMENT THEREFOR

[75] Inventor: Claude F. P. Teisen-Simony, Copenhagen, Denmark

[73] Assignee: Sign-D-Sign A/S, Stege, Denmark

[21] Appl. No.: 78,566

[22] Filed: Jul. 28, 1987

[30] Foreign Application Priority Data

Jul. 28, 1986 [DK] Denmark ..... 3589/86

[51] Int. Cl.[4] ..... E04C 2/54

[52] U.S. Cl. ..... 52/785; 52/802; 52/821

[58] Field of Search ..... 52/304–308, 52/785, 788, 790, 584, 585, 782, 785, 787, 802, 811, 821, 813; 403/292, 294, 300

[56] References Cited

U.S. PATENT DOCUMENTS

| | | | |
|---|---|---|---|
| 3,436,165 | 4/1969 | Morawski | 52/584 |
| 3,778,915 | 12/1973 | Freeman et al. | 40/125 R |
| 3,903,669 | 9/1975 | Pease et al. | 52/585 |
| 3,925,950 | 12/1975 | Von Der Ley | 52/307 |
| 4,471,595 | 9/1984 | Lanzafame | 52/584 |
| 4,566,211 | 1/1986 | Gustafson et al. | 40/605 |
| 4,628,652 | 12/1986 | Wefels | 52/306 |

FOREIGN PATENT DOCUMENTS

| | | |
|---|---|---|
| 2231297 | 12/1974 | European Pat. Off. . |
| 2452142 | 10/1980 | European Pat. Off. . |
| 2117158 | 10/1983 | United Kingdom . |

*Primary Examiner*—James L. Ridgill, Jr.

*Attorney, Agent, or Firm*—Merchant, Gould, Smith, Edell, Welter & Schmidt

[57] ABSTRACT

A plate mounting system which is particularly applicable for signposting purposes comprises polygon-shaped plate elements and connecting elements for interconnecting adjacent plate elements. Along the edges of the plate elements grooves or channels are formed on the backside of the plate elements. Each connecting element comprises two substantially parallelly extending elongated parts, each of which is adapted to engage with the channels of the plate elements with a frictional fit. The connecting elements further comprise transverse connecting parts extending between and interconnecting the elongated parts. In the outer wall parts of the wall parts defining the grooves or channels therebetween, cut-outs or recesses are formed. These recesses are outwardly open and may receive the connecting parts when one elongated part of a connecting element is inserted into one of the channels in one of the plate elements. By means of such connecting elements it is possible to interconnect plate elements in side by side relationship along a substantially common plane. The plate elements may also be interconnected with back to back.

19 Claims, 2 Drawing Sheets

PLATE MOUNTING SYSTEM, ESPECIALLY FOR SIGNPOSTING PURPOSES, AND CONNECTING ELEMENT THEREFOR

BACKGROUND OF THE INVENTION

1. Field of the Invention

The invention relates to a plate mounting system, especially for signposting purposes, and comprising polygon-shaped plate elements and at least one connecting element for interconnecting adjacent plate elements.

2. Description of the Prior Art

In railway stations, in airports and in other similar public buildings as well as in hotels and similar places frequented by large numbers of people, it is usual to put up signs giving information in the form of inscriptions or symbols. Such signs, which may, for example, indicate the location of toilets, telephones, staircases, platforms, information desks, etc., may be fastened to walls or panels by screws or similar fastening means. However, such signs are often arranged in groups on a special frame or support which is fastened to a wall or ceiling surface in such a manner that the support or frame extends across and projects from such surface. The signs may then be arranged on both sides of the support or frame so that the latter is completely covered. When, for one reason or another, a change in the signposting has to be made, this will often involve replacing the frame or support by another which corresponds to the number and size of the new signs. Thus, this known sign mounting system is not very flexible as a change in the signposting may involve replacement of a relatively costly frame or support. As the number of the various frames or supports available is usually fairly restricted, the limits of the sign groupings which may be taken into consideration are correspondingly narrow.

SUMMARY OF THE INVENTION

The invention provides a plate mounting system of the type mentioned above avoiding the use of expensive frames or supports and giving an almost unlimited degree of freedom with regard to the grouping or the mutual arrangement of the plate elements.

Thus, the present invention provides a plate mounting system, especially for posting purposes, and comprising polygon-shaped plate elements and at least one connecting element for interconnecting adjacent plate elements, each connecting element comprising a pair of mutually spaced, substantially parallelly extending elongated parts and at least one transversely extending connecting part interconnecting said pair of elongated parts, groove or channel defining means for frictionally receiving one of said pair of elongated parts being provided on each of said plate elements along and adjacent to at least one edge portion thereof, whereby said pair of elongated parts may be received in grooves or channels defined by the groove or channel defining means on a pair of said plate elements so as to hold said pair of plate elements in abutting or closely spaced relationship. Depending on the shape and size of the connecting element and on the arrangement of the groove or channel defining means on the plate elements, two or more plate elements may be interconnected in almost any desired arrangement The channel defining means may comprise pairs of spaced pins or similar projections, or the channel or groove may be formed by a depression into the material of the plate element. In the presently preferred embodiment, however, the said channel defining means comprise a pair of spaced, substantially parallel wall portions extending in the same general direction as said edge portion. In the latter case at least one of said wall portions may define at least one outwardly open recess therein for receiving said transverse connecting part of the connecting element, when one of the elongated parts of the element is received between said pair of wall portions.

A pair of plate elements may then be arranged in edge to edge relationship so that the recesses of the two plate elements are aligned, whereafter the two parallel elongated parts of a connecting element may be pressed into the adjacent grooves or channels of the two plate elements, while the transverse connecting part or parts of the connecting element is/are received in the aligned recesses. It is understood that a condition for being able to connect the two plate elements to each other in this manner is that the mutual spacing of the two parallel elongated parts of the connecting element is at least equal to the distance between the two parallelly extending adjacent grooves or channels of the adjacent plate elements. If the two said spacing and distance equal each other, the plate elements will be held against each other in a position in which their adjacent edges closely abut on each other, and if the spacing of the elongated parts of the connecting element exceeds the distance between the channels, the plate elements will be interconnected with a mutual spacing of their adjacent edges. Normally, however, the edges of the plate elements are arranged in mutually abutting relationship.

The plate elements may be square or rectangular with side edges of an uneven length. The plate elements may also be of any other polygon shape, such as a regular hexagon. Thus, the plate elements which form part of the same system need not be identical, and when this is not the case, each side length of the plate elements in the system is preferably an integer multiple of a basic length, and the system may then comprise connecting elements having lengths corresponding to the various side lengths and/or having a length corresponding to the basic length.

The plate elements are not necessarily plane, but they may, for example, be bent or folded in one direction. In that case the folding or bending line or lines is/are preferably arranged so that the folding line divides the folded edges of the plate element into lengths of which each is an integer multiple of the basic length. The use of such bent or folded plate elements renders it possible to make a plate element grouping which not only extends in a single plane, but in two or several mutually intersecting or mutually perpendicular planes.

From the above it is understood that by using the plate mounting system according to the invention, it is possible in a very simple manner to interconnect the plate elements so as to form groups of almost any shape and size in a single plane or in planes which form right or acute angles with each other. The engagement between the elongated parts of the connecting elements and the channel defining means ensures good transfer of bending stresses between the individual plate elements as well as transfer of forces in the direction of the connecting parts, and the engagement of the connecting parts with the recesses prevents the elongated parts from being displaced in the longitudinal direction of the grooves or channels.

At least in some of the plate elements or along at least one edge of some of the plate elements the grooves or channels may be formed so as to extend in the plane of the respective plate element, which means that the mouth or opening of the groove or channel is defined along the respective side edge of the plate element, and that the central plane of the channel substantially coincides or is parallel to the plane of the plate element. The groove or channel defined by said groove or channel defining means along at least one of said edge portions of each plate element may open into a major side surface of the respective plate element, which means that the central plane of the channel extends transversely to the plane of the plate element. The channels of the plate elements are then preferably defined between wall parts projecting from the back side of the respective plate element. When such wall parts are made from a resilient material such as plastic or metal, it is possible to obtain a particularly good friction engagement between the said wall parts and the elongated parts of the connecting element. Apart from the said recesses the said wall parts may be unbroken, but they may also be interrupted to obtain an increased elastic effect. If plane plate elements are used, and if all of the grooves or channels thus open at one of the major side surfaces of the plate element, the groupings obtainable by interconnecting the plate elements will be substantially plane. By joining two plate elements of which one has a channel with a central plane coinciding with or extending parallel to the plane of the respective plate element, while the other has a channel opening at one major side surface of the plate element and thus having a central plane extending transversely to the plate element, the two plate elements may be joined so as to extend transversely to each other or at right angles to each other.

The connecting elements may be such that each of their parallel elongated parts are completely received in a single one of the channels of the plate elements. In a preferred embodiment, however, each groove or channel and/or each of the recesses has a depth which is only about half the width or thickness of each of the elongated parts and/or each of the connecting parts, respectively, of a connecting element. When a first pair of plate elements arranged either in a common plane or in planes intersecting each other, have been interconnected in this manner, a second pair of plate elements may be connected to the first pair of plate elements, because the portions of the elongated parts of the connecting element not received in the channels of the first pair of plate elements, may be received in the channels of the second pair of plate elements, the plate elements in the first and second pairs being arranged back to back. This means that by using the mounting system according to the invention it is possible to make plate element groupings where only the fronts of the plate elements are visible, which fronts may be provided with inscriptions, legends, informative symbols and/or decorations, while the less pretty backs of the plate elements and the connecting elements interconnecting the plate elements will be completely hidden.

The elongated parts of the connecting elements may have any suitable cross-sectional shape. They may, for example, have a cross-sectional shape which recalls a dumbbell or a bone, and which has enlarged or bead-like end portions which are adapted to be received in correspondingly shaped grooves or channels which may then be defined between resilient wall parts. In the preferred embodiment the elongated parts of the connecting elements are rod-shaped parts having a substantially rectangular cross-section. Such a rectangular cross-section is efficient to transfer bending stresses between interconnected plate elements.

The transverse connecting parts of the connecting elements may have any suitable cross-sectional shape which does not necessarily correspond to the shape of the corresponding recesses in the outer wall parts of the channels. However, in the preferred embodiment the transverse connecting parts have a substantially circular cross-section, and the recesses have a substantially semi-circular shape so that half of the cross-section of the connecting parts is received in one of the recesses.

It may be desired to attach the grouping of plate elements made by means of the mounting system according to the invention, to a wall or a ceiling or to another support. this may be effected by attaching one of the connecting elements to this support and preferably in such a manner that an outer side surface of one of the elongated parts engages with the wall or support in question. Such fastening of the connecting element to a support may, of course, be carried out in any manner, for example by means of an adhesive or by means of mechanical fastening means, such as screws, nails, brackets or similar means. In a preferred embodiment at least one of the connecting parts of a connecting element defines a through-going axial bore therein. The fastening of the connecting element may then be carried out by passing a screw or a nail through this axial bore whereafter the screw or nail is screwed or driven into the support.

The plate mounting system according to the invention may further comprise a corner connecting member having a substantially angular cross-section and being adapted to engage with complementarily shaped channels or grooves in a corner area of at least a pair of said plate elements, whereby said pair of plate elements may be arranged in an opposed and preferably mutually abutting relationship. Such corner connecting members contribute to further stabilizing the connection between two such plate elements which are arranged back to back, opposite to and against each other.

The invention also provides a connecting element for use in a plate mounting system as described above, and the connecting element according to the invention is characterized in comprising a pair of mutually spaced, substantially parallelly extending elongated parts, and at least one transversely extending connecting part interconnecting said pair of elongated parts. Thus, the connecting element is shaped approximately like a ladder in which the elongated parts constitute the bearers while the connecting parts constitute the steps. The connecting parts are preferably, but not necessarily equidistant. They may then be brought to engage with equally equidistant recesses in the plate elements regardless of the orientation of the connecting element.

BRIEF DESCRIPTION OF THE DRAWING

The invention will now be described in detail with reference to the drawing in which.

DESCRIPTION OF THE PREFERRED EMBODIMENT

Figure 1:
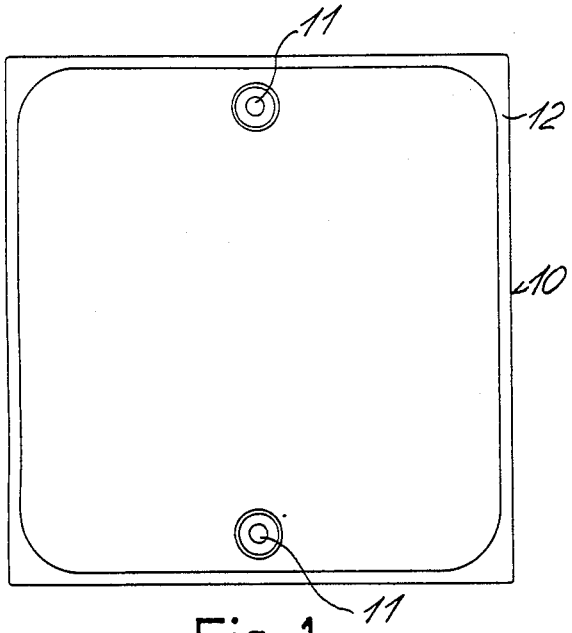
FIG. 1 is a front view of a plate element.
Figure 2:
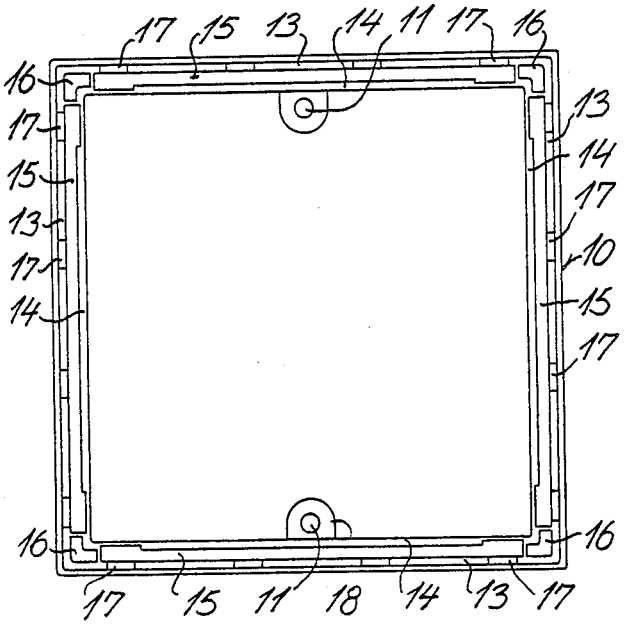
FIG. 2 is a back view of the plate element shown in FIG. 1.

The plate element 10 shown in FIGS. 1 and 2 has a substantially plane front surface which is provided with a pair of screw holes 11 enabling the plate element to be screwed to a support in a conventional manner. The front surface of the plate element 10 has a raised edge portion 12 so that a plate, a sheet or a foil (not shown) with legends or informative and/or decorative symbols, optionally covered by a transparent plastic or glass plate (not shown), may be arranged on the front surface of the plate and within the edge portion. Thus, for example, the front surfaces of the plate elements may be provided with legends or symbols to designate the location of toilets, staircases, telephones, etc.

Figure 3:
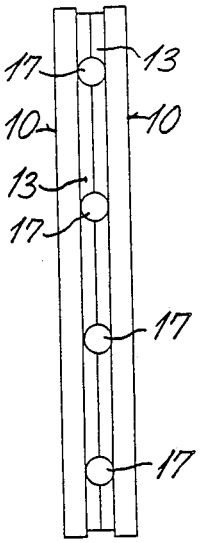
FIG. 3 shows two plate elements arranged in back to back relationship.

On a back surface the plate element 10 outer wall parts 13 and inner wall parts 14 which extend mutually parallelly and along the edges of the plate element and project substantially at right angles from the plane of the plate element so that an outwardly open groove or channel 15 is formed along each side edge of the plate element and between the parallel outer and inner wall parts 13 and 14. At each corner of the plate element an angular groove or recess 16 is defined between the wall parts. In each of the outer wall parts 13 a number of equidistant, outwardly open semi-circular recesses 17 have been formed. When two identical plate elements 10 are arranged with back to back, these recesses 17 in the outer wall parts 13 of the two plate elements 10 will be aligned so that together they form circular holes as shown in FIG. 3. Around each screw hole 11 a reinforcing projection 18 has been formed as shown in FIG. 2. The plate element shown in FIGS. 1–3 may be produced from any suitable material, but it is preferably injection-moulded integrally from plastic material.

Figure 4:
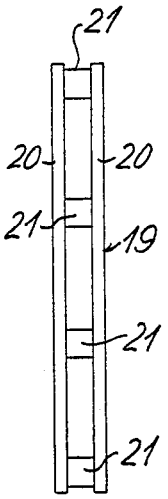
FIG. 4 is a plan view of a connecting element.
Figure 5:
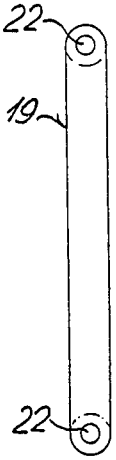
FIG. 5 is a side view of the connecting element shown in FIG. 4.

FIGS. 4 and 5 show a connecting element 19 which is used for joining or interconnecting plate elements of the type shown in FIGS. 1–3. This connecting element has two parallelly extending elongated parts 20, each of which is rod-shaped and rounded at its opposite ends and has a substantially rectangular cross-section. The elongated parts 20 are interconnected by means of a number of equidistant transverse connecting parts 21 which have a substantially circular cross-section with a diameter corresponding to the diameter of the recesses 17, and the mutual distance between the connecting parts 21 corresponds to the mutual distance between the recesses 17 formed in the outer wall parts 13 of the plate elements 10. At each end the connecting element 19 is provided with a through-going bore 22 which may receive a screw, a nail or a similar fastening member by means of which the connecting element 19 may be fastened, if desired, to a wall or ceiling surface or to a similar supporting surface.

Figure 6:
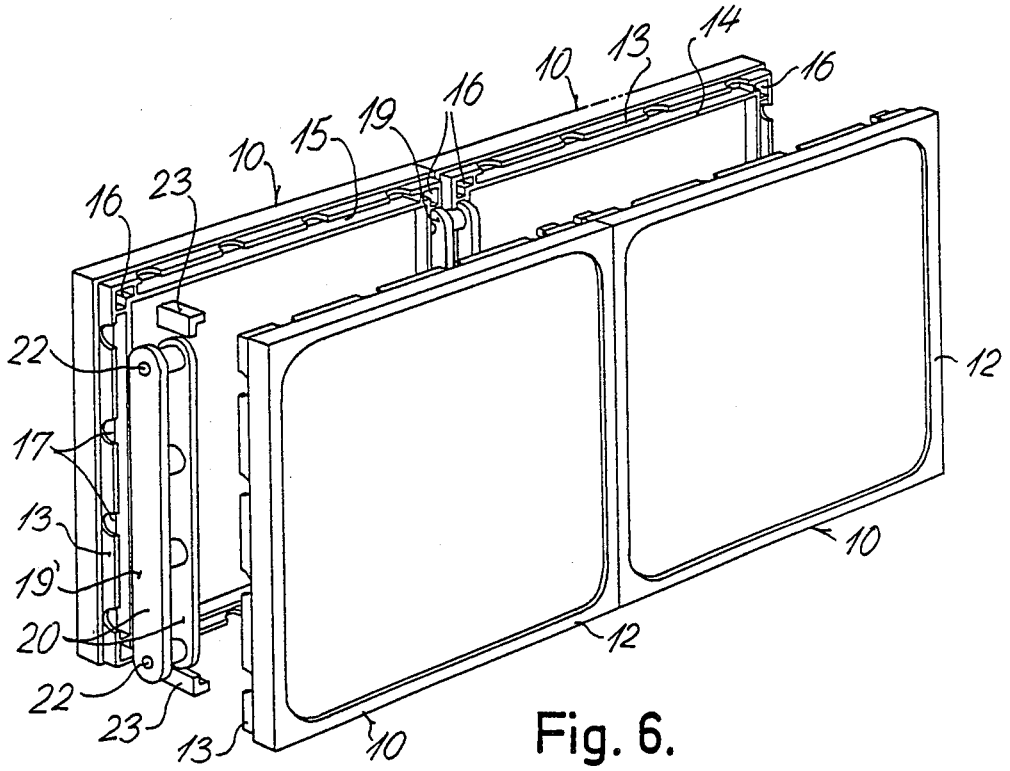
FIG. 6 is a perspective view illustrating how four plate elements may be mounted in pairs with back to back by means of only two connecting elements.

As shown in FIG. 6, a first pair of plate elements 10 may be interconnected so as to extend along a common plane, by pressing the elongated parts 20 of a connecting element 19 into the grooves or channels 15 extending along the adjacent edges of the two plate elements 10, while the transverse connecting parts 21 of the connecting element 19 are received in the aligned semi-circular recesses 17. As the channels 15 have a depth which is only about half the width of the elongated parts 20, half the width of the connecting element 19 will project from the outer edges of the wall parts 13 and 14 defining the channels 15. The connecting element 19 may therefor retain a second pair of plate elements 10 which are arranged as shown in FIG. 6 with their edges against each other, and when the two pairs of plate elements with back to back are pressed against each other, the single connecting element 19 shown will be able to interconnect all four plate elements 10 so that only their fronts are visible. The stability of this grouping of plate elements may optionally be increased by using a number of angular joining members 23, the opposite end portions of which are engaged with the oppositely arranged and oppositely directed angular grooves 16 in the corner areas of the plate elements.

It is understood that by using more connecting elements 19 in the manner shown it is possible to make a grouping of a larger or smaller number of plate elements, because a plate element may be fastened along each free side edge of any plate element, and because the backside of a plate element may be fastened to the backside of each of the plate elements so mounted.

Although the drawing only shows square plate elements, it should be understood that plate elements formed as other polygons, for example as a regular hexagon, and square plate elements with other side lengths, for example a side length half the side length of the plate element 10 shown in the drawing may alternatively or additionally be used. It is further possible to use plate elements having a rectangular outline, the side lengths of which are different, one side length for example being double or quite another multiple of the other side length. Finally, at least some of the plate elements may have a bent or folded shape as mentioned above so that spatial structures may be made by means of the plate mounting system according to the invention.

If it is desired to fasten a grouping of plate elements interconnected in the above described manner to a wall or ceiling surface or to another supporting surface, this may be done by fastening a connecting element 19', which may correspond completely to the connecting element designated 19 with respect to shape, to the supporting surface by means of screws passed through the bores 22. Then the interconnected plate elements may be mounted on the connecting element 19' thus fastened by bringing one of the elongated parts 20 of the connecting element into engagement with the grooves or channels 15 along a free side edge of the plate element grouping as indicated in FIG. 6.

It should be understood that within the scope of the invention various modifications may be made to the embodiment shown in the drawings. Thus, the transverse connecting parts of the connecting elements 19 need not necessarily have a circular cross-section, and the elongated parts 20 need not have a rectangular cross-section, but may have any other cross-section permitting a suitable frictional connection between the connecting element and the channels having a suitable form. Although the invention has been described above substantially with reference to plate elements used for signposting, it is obvious that plate elements used for quite other purposes, such as for toys, may also be interconnected by the use of a mounting system according to the invention.

I claim:

1. A plate assembly system comprising:

at least two plate elements each having a pair of opposite major side surfaces, edge surfaces defining a polygon-shaped circumference of the plate element, and means defining a channel in the plate element adjacent to and substantially coextensive with at least a first of the edge surfaces of the plate element, and at least one separate connecting element having a pair of mutually spaced, substantially parallelly extending elongated parts which are interconnected by at least one transversely extending part, the cross-sectional shape of each elongated part being interrrelated with the shape of the channels of the plate elements so as to allow said pair of elongated parts to be frictionally and coextensively received in either one of the channels in said two plate elements whereby the plate elements may be interconnected by the connecting element with their said first edge surfaces arranged in a juxtaposed relationship.

2. A plate assembly system according to claim 1 wherein said plate elements are signposts.

3. A plate assembly system according to claim 1, wherein said channel has a depth which is about half the thickness of each of the elongated parts of the connecting element.

4. A plate assembly system according to claim 1, wherein the elongated parts of the connecting element are rod-shaped parts having a substantially rectangular cross-section.

5. A plate assembly system according to claim 1, wherein the transversely extending part of the connecting element has a substantially circular cross-section.

6. A plate assembly system according to claim 1, wherein at least one of the transversely extending parts of the connecting element defines an axial bore therethrough.

7. A plate assembly system according to claim 1, wherein said channel defining means comprise a pair of spaced, substantially parallel inner and outer wall portions extending in the same general direction as said first edge surface.

8. A plate assembly system according to claim 7, wherein said outer wall portion defines at least one outwardly open recess therein for receiving said transversely extending part of the connecting element, when one of the elongated parts of the connecting element is received between said pair of wall portions.

9. A plate assembly according to claim 1, wherein said channel opens into one of the major side surfaces of the respective plate element.

10. A plate assembly system according to claim 9, further comprising a corner connecting member which has a substantially angular cross-section and which is adapted to engage with complementarily shaped channels defined in corner areas of said plate elements, whereby said plate elements may be arranged in an opposed and mutually abutting relationship.

11. A connecting element for a plate mounting system according to claim 1, and comprising a pair of mutually spaced, substantially parallelly extending elongated parts and at least one transversely extending connecting part interconnecting said pair of elongated parts.

12. A connecting element according to claim 11, wherein said elongated parts are rod-shaped parts having a substantially rectangular cross-section, and in that the connecting part has a substantially circular cross-section.

13. Connecting element according to claim 11, wherein the elongated parts and the connecting parts are integrally molded from plastic.

14. A plate assembly system comprising at least two pairs of plate elements, each element having a pair of opposite first and second major side surfaces, edge surfaces defining a polygon-shaped circumference of the plate element, and means defining in the plate element a channel opening in said first major side surface and extending adjacent to and along at least one of the edge surfaces of the plate element, and at least one separate connecting element having a pair of mutually spaced, substantially parallelly extending elongated parts, which are interconnected by at least one transversely extending part, the cross-sectional size and shape of the elongated parts being interrelated with the size and shape of the channels of the plate elements so as to allow said pair of elongated parts to be frictionally and coextensively received in either one of the channels beneath of said pairs of plate elements, whereby said two pairs of plate elements may be interconnected by the connecting element with their said first edge surfaces arranged in a juxtaposed relationship and with the said first major side surfaces of the plate element in mutual

15. A plate assembly system according to claim 14, further comprising a corner connecting member which has a substantially angular cross-section and which is adapted to engage with complementarily shaped further channels defined in corner areas of said plate elements, when said pairs of plate elements are arranged with their first major side surfaces in an opposed, mutually abutting relationship.

16. A plate assembly system according to claim 14, wherein said channel defining means comprise a pair of spaced, substantially parallel inner and outer wall portions extending in the same general direction as said first edge portion.

17. A plate assembly system according to claim 16, wherein said outer wall portion defines at least one outwardly open recess therein for receiving said transversely extending part of the connecting element, when one of the elongated parts of the connecting element is received between said pair of wall portions.

18. A plate assembly system according to claim 17, wherein the elongated parts of the connecting element are rod-shaped parts having a substantially rectangular cross-section, while the transverse connecting part has a substantially circular cross-section.

19. A plate assembly comprising:

at least two plate elements each having a pair of major side surfaces, edge surfaces defining a polygon-shaped circumference of the plate element, and means defining a channel in the plate element adjacent to and substantially coextensive with at least a first of the edge surfaces of the plate element, the plate elements being arranged with their said first edge surfaces in a juxtaposed relationship, and at least one separate connecting element having a pair of mutually spaced, substantially parallelly extending, elongated parts which are interconnected by at least one transversely extending part, the elongated parts extending along and being frictionally and releasably received in either one of the channels of said two plate elements

* * * * *

UNITED STATES PATENT AND TRADEMARK OFFICE

CERTIFICATE OF CORRECTION

PATENT NO. : 4,813,197

DATED : 21 March 1989

INVENTOR(S) : Claude Teisen-Simony

It is certified that error appears in the above-identified patent and that said Letters Patent is hereby corrected as shown below:

In column 1, line 45, after "for" insert --sign--;

In column 1, line 64, after "arrangement", insert --.--;

In column 4, line 17, "this" should be --This--;

In column 8, line 27, after "mutual" insert --abutting relationship--.

Signed and Sealed this

Twenty-sixth Day of November, 1991

*Attest:*

HARRY F. MANBECK, JR.

*Attesting Officer*

*Commissioner of Patents and Trademarks*